US012510071B2

(12) United States Patent
Pollard et al.

(10) Patent No.: US 12,510,071 B2
(45) Date of Patent: Dec. 30, 2025

(54) ROTARY GEAR PUMP WITH A CENTERED DRIVE GEAR

(71) Applicant: ADVANCING PUMP TECHNOLOGY CORP., Calgary (CA)

(72) Inventors: Kim Pollard, Calgary (CA); Ryan Chachula, Calgary (CA); Dale Serafinchan, Calgary (CA); Tom Bryant, Calgary (CA)

(73) Assignee: Advancing Pump Technology Corp., Calgary (CA)

( * ) Notice: Subject to any disclaimer, the term of this patent is extended or adjusted under 35 U.S.C. 154(b) by 0 days.

(21) Appl. No.: 18/254,336

(22) PCT Filed: Nov. 25, 2020

(86) PCT No.: PCT/CA2020/051605
§ 371 (c)(1),
(2) Date: Feb. 2, 2024

(87) PCT Pub. No.: WO2022/109707
PCT Pub. Date: Jun. 2, 2022

(65) Prior Publication Data

US 2024/0011486 A1 Jan. 11, 2024

(51) Int. Cl.
*F04C 2/08* (2006.01)
*F04C 2/18* (2006.01)
(Continued)

(52) U.S. Cl.
CPC ..... *F04C 11/001* (2013.01); *F04C 2/084* (2013.01); *F04C 2/18* (2013.01); *F04C 13/008* (2013.01);
(Continued)

(58) Field of Classification Search
CPC ..... F04C 11/001; F04C 2/084; F04C 2/18; F04C 13/008; F04C 14/02; F04C 14/26; F04C 23/001
See application file for complete search history.

(56) References Cited

U.S. PATENT DOCUMENTS 1,593,820 A 7/1926 Gates
1,654,329 A 12/1927 Hawley, Jr.
(Continued)

FOREIGN PATENT DOCUMENTS

CN 204512918 U * 7/2015 ..... F16N 13/20
DE 102012216122 A1 4/2013
WO 2017143459 A1 8/2017

OTHER PUBLICATIONS

English translation by CN204512918 by PE2E Sep. 18, 2024.*
(Continued)

*Primary Examiner* — Deming Wan
(74) *Attorney, Agent, or Firm* — Bennett Jones LLP

(57) ABSTRACT

A rotary gear pump includes a housing, a drive gear, and an idler gear. The housing has a central axis extending in an axial direction, and defines an intake port, a discharge port, and a gear chamber in fluid communication with the intake port and the discharge port. The drive gear and the idler gear are intermeshed, and rotatably disposed within the gear chamber for displacing fluid from the intake port to the discharge port. The drive gear has an axis of rotation that is coaxial with the housing central axis. The drive gear may be directly coupled to the idler gear of a second rotary gear pump, which idler gear has an axis of rotation that is coaxial with the axis of rotation of the drive gear.

4 Claims, 11 Drawing Sheets

(51) Int. Cl.

| | |
|---|---|
| ***F04C 11/00*** | (2006.01) |
| ***F04C 13/00*** | (2006.01) |
| ***F04C 14/02*** | (2006.01) |
| ***F04C 14/26*** | (2006.01) |
| ***F04C 23/00*** | (2006.01) |
| ***F04C 28/02*** | (2006.01) |

(52) U.S. Cl.
CPC .... *F04C 2240/30* (2013.01); *F04C 2250/102* (2013.01)

(56) References Cited

U.S. PATENT DOCUMENTS

| | | | | |
|---|---|---|---|---|
| 2,202,439 | A | 5/1940 | Topanelian, Jr. | |
| 3,545,898 | A | 12/1970 | Bobst | |
| 4,065,235 | A | 12/1977 | Furlong et al. | |
| 5,423,661 | A | 6/1995 | Gabeler et al. | |
| 5,466,131 | A | 11/1995 | Altham | |
| 8,342,814 | B2 * | 1/2013 | Ford | F04C 2/18 417/53 |
| 2003/0223896 | A1 | 12/2003 | Gilbert et al. | |
| 2007/0196229 | A1 | 8/2007 | Gay | |
| 2007/0248480 | A1 | 10/2007 | Mayer et al. | |
| 2009/0304526 | A1 | 12/2009 | Ford | |
| 2011/0286872 | A1 | 11/2011 | McGuffey | |
| 2012/0207626 | A1 * | 8/2012 | Dalton | F04C 2/18 417/253 |
| 2015/0064034 | A1 | 3/2015 | Davis et al. | |
| 2018/0355864 | A1 * | 12/2018 | Trossmann | F04C 2/16 |

OTHER PUBLICATIONS

Preliminary Office Action (Apr. 16, 2024) Brazilian Patent and Trademark Office, Application No. BR112023010119-0.

Examination Report (Jan. 2024) Saudi Authority for Intellectual Property, Application No. 523440899.

International Search Report and Written Opinion (2) (Aug. 12, 2021) International Search Authority, Application No. PCT/CA2020/051605.

* cited by examiner

ROTARY GEAR PUMP WITH A CENTERED DRIVE GEAR

FIELD OF THE INVENTION

The present invention relates to a rotary gear pump having a housing that contains an idler gear and a drive gear.

BACKGROUND OF THE INVENTION

Conventional positive displacement type rotary gear pumps typically have a housing with an intake port and an opposing discharge port. A drive gear is driven by a prime mover via a drive shaft. The prime mover is typically transversely offset from the center of the pump housing because the prime mover is typically centered relative to the drive shaft, which is transversely offset from the center of the housing. This may be problematic when the pump is used in an environment with limited transverse space, such as a downhole tubular in a wellbore.

One configuration has the prime mover transversely aligned with the center of the housing by using an offset drive coupling such as a pair of universal joints connected by a shaft, or a device known as a "wobble sprocket", to couple the drive shaft to the prime mover. However, such offset drive couplings may impart undesirable vibration to the pump, may reduce mechanical efficiency of torque transmission from the prime mover to the drive shaft, and provide additional moving parts susceptible to wear and failure.

Accordingly, there remains a need in the art for a rotary gear pump that allows for coupling of a prime mover transversely aligned with the center of the housing, without use of an offset drive coupling. Preferably, such a pump has a capacity comparable to that of a conventional rotary gear pump having a similarly sized housing. Preferably, such a pump may be adapted for use in environments with limited transverse space, such as a downhole tubular in a wellbore.

SUMMARY OF THE INVENTION

In one aspect, the present invention comprises a rotary gear pump. The rotary gear pump includes a housing, a drive gear, and an idler gear. The housing has a central axis extending in an axial direction, and defines an intake port, a discharge port, and a gear chamber in fluid communication with the intake port and the discharge port. The drive gear and the idler gear are intermeshed, and rotatably disposed within the gear chamber for displacing fluid from the intake port to the discharge port. The drive gear has an axis of rotation that is coaxial with the housing central axis.

In another aspect, the present invention comprises a pump system comprising a pump as described above. The pump system also comprises a drive shaft coupled to the drive gear of the pump for driving rotation of the drive gear. The pump system also comprises a prime mover coupled to the drive shaft for driving rotation of the drive shaft. In embodiments, an axis of rotation of the drive shaft and/or a central axis of the prime mover is coaxial with the housing central axis of the at least one pump.

In another aspect, the present invention comprises a pump assembly comprising first pump and a second pump. Each of the pumps comprises a housing having a central axis extending in an axial direction, and defining an intake port, a discharge port, and a gear chamber in fluid communication with the intake port and the discharge port. Each of the pumps also comprises a drive gear intermeshed with an idler gear, wherein the drive gear and the idler gear are rotatably disposed within the gear chamber for displacing fluid from the intake port to the discharge port. The first pump drive gear has an axis of rotation that is coaxial with the central axis of the first pump housing. In some embodiments, the first pump drive gear is directly coupled to the second pump drive gear, and an axis of rotation of the first pump drive gear and an axis of rotation of the second pump drive gear are coaxial with each other. In other embodiments, the first pump idler gear is directly coupled to the second pump drive gear, and an axis of rotation of the first pump idler gear and an axis of rotation of the second pump drive gear are coaxial with each other.

In another aspect, the present invention comprises a pump assembly comprising first pump and a second pump. Each of the pumps comprises a housing having a central axis extending in an axial direction, and defining an intake port, a discharge port, and a gear chamber in fluid communication with the intake port and the discharge port. Each of the pumps also comprises a drive gear intermeshed with an idler gear, wherein the drive gear and the idler gear are rotatably disposed within the gear chamber for displacing fluid from the intake port to the discharge port. The first pump idler gear is directly coupled to the second pump drive gear, and an axis of rotation of the first pump idler gear and an axis of rotation of the second pump drive gear are coaxial with each other. In some embodiments, the first pump drive gear has an axis of rotation that is coaxial with the central axis of the first pump housing.

BRIEF DESCRIPTION OF THE DRAWINGS

In the drawings shown in the specification, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF EMBODIMENTS OF THE INVENTION

Definitions.

The present invention relates to a rotary gear pump. Any term or expression not expressly defined herein shall have its commonly accepted definition understood by a person skilled in the art. As used herein, the following terms have the following meanings.

"Axial" refers to the direction parallel to the axes of rotation of the gears of the rotary gear pump. "Transverse" refers to a direction perpendicular to the axial direction. For example, in FIG. 4, the pump is disposed such that the gears rotate about vertical axes of rotation, and therefore the axial direction is indicated by the vertical axis (A), while the transverse direction is indicated by a horizontal axis (T). These directional terms are used only for convenience in describing the relative directions or positions of the pump or parts thereof, and do not limit the actual orientation of the pump in use.

"Central axis" of an element of a pump (such as the housing or a gear chamber, as described below), a pump assembly, or a pump system, refers to an axis that extends in the axial direction through the geometric center of a cross-section of the element in the transverse direction.

"Fluid" refers to any substance that is capable of flowing and conforming to the shape of its container. A fluid may be a liquid, a gas, or a mixture of liquid and gas. A fluid may carry solid matter. As non-limiting examples, a fluid may be a mixture of oil, gas, water, and sand, or a well treatment fluid.

"Gear" refers to a wheel having teeth, cogs, lobes, or other contours that mesh with teeth, cogs, lobes, or contours of another part (e.g., another gear) so that rotation of the wheel induces rotation of the other part.

"Prime mover" refers to any machine that converts energy from an energy source into kinetic energy, to apply a torque to a driven part coupled to the machine. As non-limiting examples, a prime mover may comprise one or a combination of an internal combustion engine, an electric motor, a hydraulic motor, a pneumatic motor, or a turbine or wheel driven by wind or water. As non-limiting examples, a prime mover may be coupled to the driven part by direct attachment, a gear, a belt, a friction coupling, a fluid coupling, or other mechanical connection.

Figure 1:
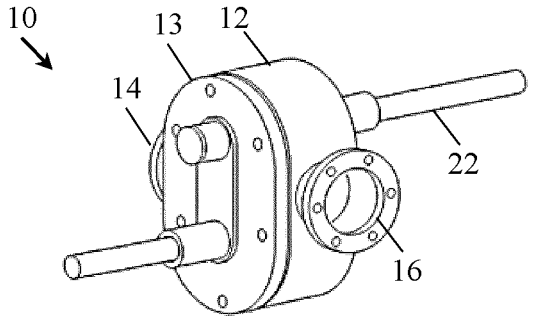
FIG. 1 Prior Art
FIG. 1 shows a perspective view of a conventional rotary gear pump.
Figure 2:
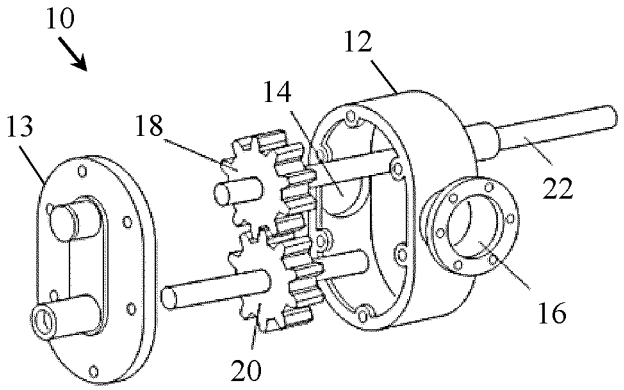
FIG. 2 Prior Art
FIG. 2 shows an exploded perspective view of the pump of FIG. 1.

Prior art FIGS. 1 and 2 show an assembled view and an exploded view, respectively, of a conventional positive displacement type rotary gear pump (10). The pump (10) has a housing (12) that defines an intake port (14), and a discharge port (16). The housing (12) contains a drive gear (18) and an intermeshed idler gear (20). In use, a prime mover (not shown) is coupled to the drive gear (18) via a drive shaft (22) to drive rotation of the drive gear (18).

The prime mover is typically transversely offset from the center of the housing (12) because the prime mover is typically centered relative to the drive shaft (22), which is transversely offset from the center of the housing (12). This is problematic when the pump (10) is used in an environment with limited transverse space, such as a downhole tubular in a wellbore.

Figure 3:
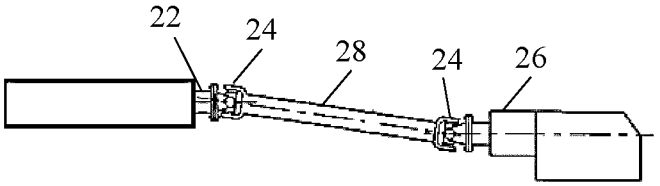
FIG. 3 Prior Art
FIG. 3 shows a prime mover coupled to a drive shaft by a pair of universal joints and a shaft.

As shown in FIG. 3, the prime mover (26) may be transversely aligned with the center of the housing (12) by using an offset drive coupling such as a pair of universal joints (24) connected by a shaft (28), or a device known as a "wobble sprocket", to couple the drive shaft (22) to the prime mover (26). However, such offset drive couplings may impart undesirable vibration to the pump (10), may reduce mechanical efficiency of torque transmission from the prime mover (26) to the drive shaft (22), and provide additional moving parts susceptible to wear and failure.

Pump.

Figure 4:
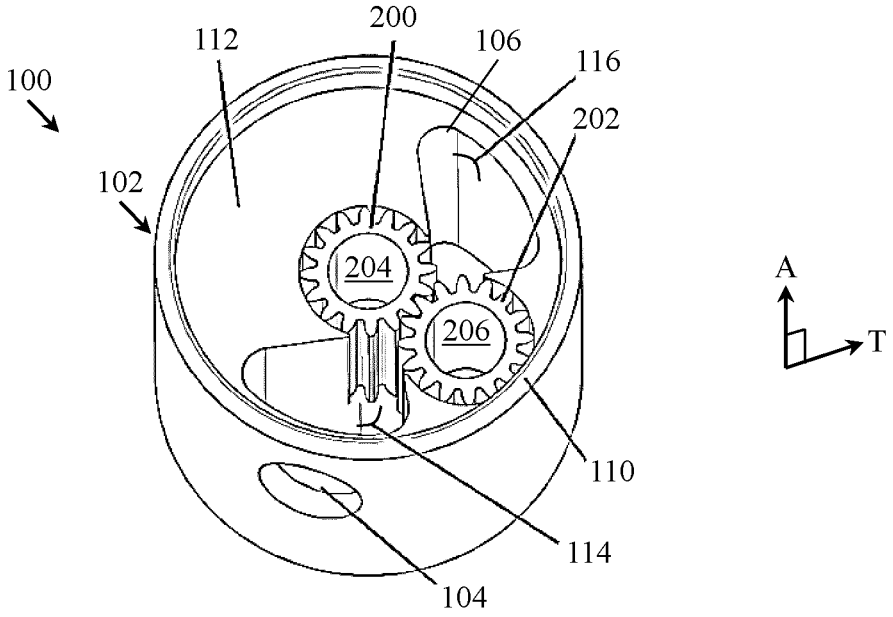
FIG. 4 shows a perspective view of an embodiment of a rotary gear pump of the present invention.
Figure 5:
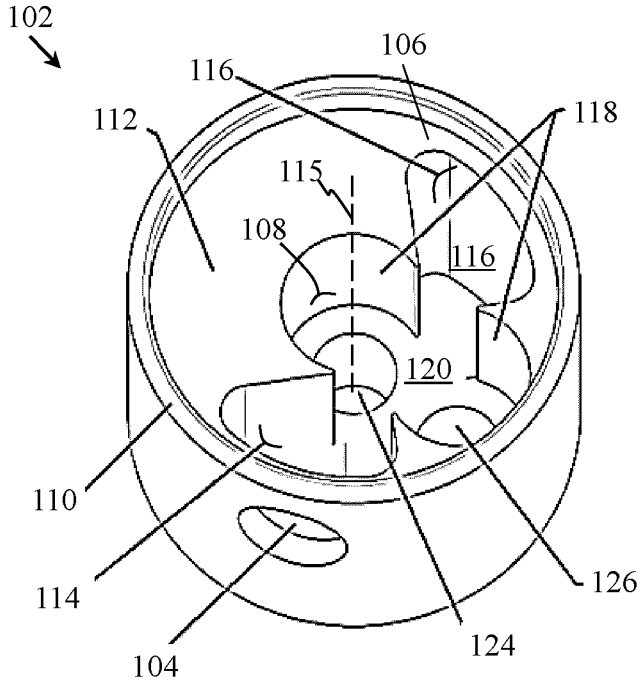
FIG. 5 shows a perspective view of the housing of the pump of FIG. 4.
Figure 6:
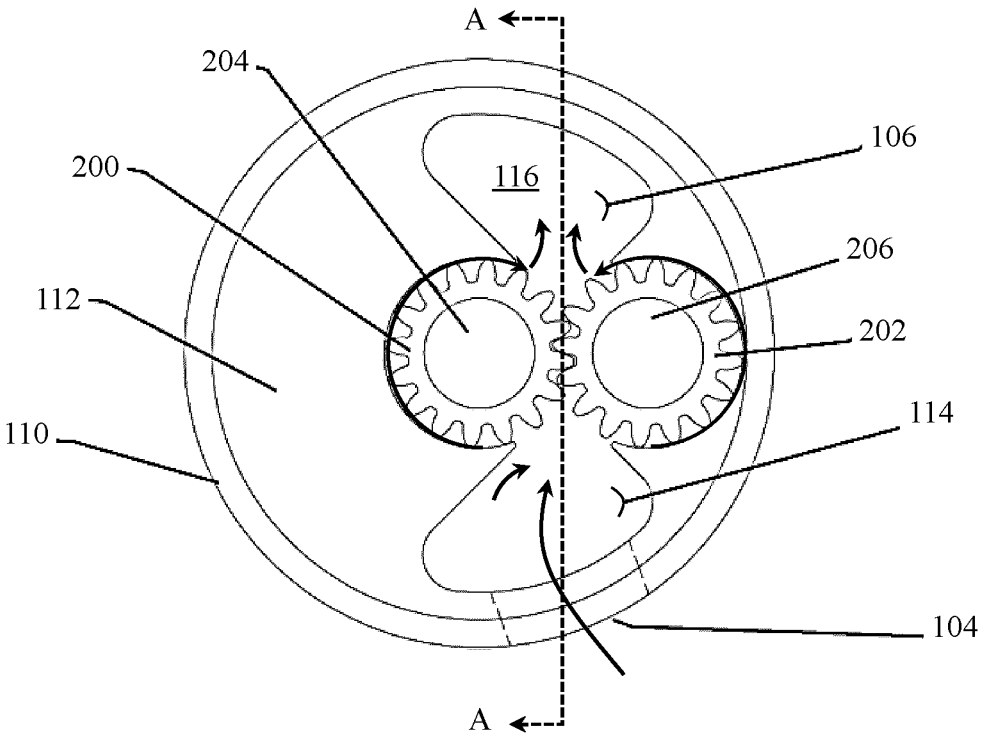
FIG. 6 shows a transverse view of an end of the pump of FIG. 4.
Figure 7:
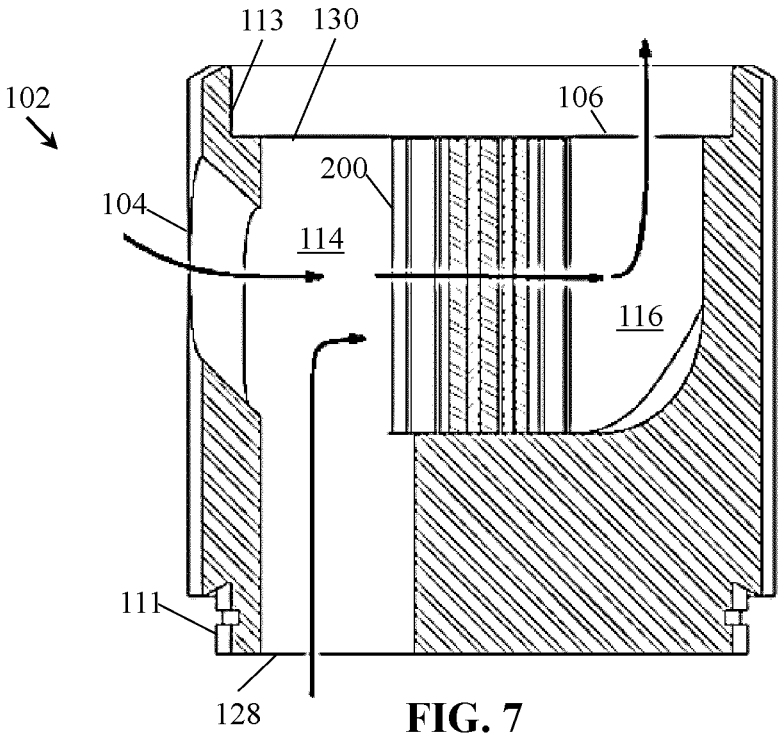
FIG. 7 shows an axial sectional view of the pump of FIG. 6 along line A-A.

FIGS. 4, 6, and 7 show different views of an embodiment of a rotary gear pump (100) of the present invention. The pump (100) includes a housing (102), a drive gear (200), and an idler gear (202). FIG. 5 shows the housing (102) in isolation. In one embodiment, these parts may be made with corrosion resistant materials such as metal alloys or metal composite materials, suitable for exposure to reservoir fluids produced from an oil and gas well, or well treatment fluids, over a wide range of temperatures. In one embodiment, the exposed surfaces of these parts may be made of or coated with wear-resistant and low-friction materials such as tungsten carbide or a ceramic material.

Housing of Pump.

The housing (102) has a central axis in the axial direction (A). For example, in the embodiment shown in FIG. 5, the transverse cross-section of the housing (102) has the shape of a circle, and therefore the central axis of the housing (102) (shown by the dashed line (115)) extends in the axial direction (A) through the center of the circle. As another example (not shown), the transverse cross-section of the housing (102) may have the shape of an ellipse, and therefore the central axis of the housing (102) may extend in the axial direction through the intersection of the major and minor axes of the ellipse.

In some embodiments, the housing (102) is formed by a casing (110) that circumscribes a body (112). The casing (110) has a cylindrical outer surface. The casing (110) defines a transversely-oriented intake port (104) to receive fluid from a fluid source, such as a casing annulus that surrounds a production string in a wellbore, or a fluid supply line. One end of the casing (110) defines a threaded pin end (111) (see FIG. 7) for mating with a threaded box end of another component of a pump assembly (for example, see FIG. 10). The pin end (111) defines a groove for retaining an O-ring gasket (not shown) for creating a fluid-tight seal with the tubular of the pump assembly. The other end of the casing (110) defines a threaded box end (113) (see FIG. 7) for mating with a threaded pin end of another component of a pump assembly (for example, see FIG. 10).

In some embodiments, the body (112) defines a cavity, which includes three parts: a gear chamber (108) (see FIG. 5); an intake chamber (114); and a discharge chamber (116). The gear chamber (108) contains the drive gear (200) and the idler gear (202), such that the axis of rotation of the drive gear (200) is coaxial with the central axis (115) of the housing (102) in a transverse cross-section. The gear chamber (108) is formed by a pair of opposed, axially extending, partial cylindrical walls (118), and a transverse wall (120). The transverse wall (120) defines a pair of bores (124, 126), which rotatably receive and allow passage of a drive shaft and an idler shaft (not shown) for attachment to the drive gear (200) and the idler gear (202), respectively.

In some embodiments, the intake port (104) leads into the intake chamber (114) which then leads to the gear chamber (108). In a transverse plane, the intake chamber (114) has an asymmetric fan shape that narrows towards the gear chamber (108), to efficiently direct fluid from the intake port (104) towards the intermeshing teeth of the drive gear (200) and the idler gear (202), with limited turbulence. The intake chamber (114) extends axially through the body (112) to permit fluid communication axially through the housing (102) from an open first end (128) to a second end (130) (see FIG. 7). The open first end (128) may serve as an axially-oriented secondary intake port of the pump (100). The second end (130) may closed or may be open as another intake passage.

In some embodiments, the discharge chamber (116) extends transversely from the gear chamber (108) and terminates in an axially-oriented discharge port (106) for discharging fluid axially to a destination such as a production tubing string, or a fluid discharge line. In a transverse plane, the discharge chamber (116) has an asymmetric fan shape that widens away from the gear chamber (108), to efficiently direct fluid from the intermeshing teeth of the drive gear (200) and the idler gear (202) towards the discharge port (106), with limited turbulence.

Alternative Embodiments of Intake Port(s) and Discharge Ports(s).

Alternative embodiments of the housing (102) (not shown) described below may define one or more intake ports, and one or more discharge ports in a variety of different ways to achieve different fluid flow paths. The presence or absence of intake ports and discharge ports as contemplated by embodiments of the housing (102) described herein may be combined in various ways, subject only to the limitation that the housing (102) defines at least one intake port (whether transversely-oriented and/or axially-oriented), and at least one discharge port (whether transversely-oriented and/or axially-oriented).

In an alternative embodiment of the housing (102) (not shown), the housing (102) may not define a transversely-oriented intake port (104), but have the axially-oriented first open end (128) of the intake chamber (114) serving as the only intake port of the pump (100).

In an alternative embodiment of the housing (102) (not shown), the first end (128) of the intake chamber (114) may be closed, leaving the axially-oriented intake port (104) as the only intake port of the pump (100).

In an alternative embodiment of the housing (102) (not shown), the second end (130) of the intake chamber (114) may be closed, such that fluid in the intake chamber (114) received from the transversely-oriented intake port (104) (if present) or the axially-oriented open first end (128) (if present) must flow exclusively to the gear chamber (108).

In an alternative embodiment of the housing (102) (not shown), the housing (102) may define a transversely-oriented discharge port, in a manner analogous to how the housing (102) defines the intake port (104) shown in FIGS. 4 to 7. In such embodiment, the axially-oriented discharge port (106) in the embodiment of the housing (102) shown in FIGS. 4 to 7 may or may not be present.

In an alternative embodiment of the housing (102), the discharge chamber (116) may have two open ends, in a manner analogous to how the intake chamber (114) has two open ends (128, 130) in the embodiment of the housing (102) shown in FIG. 7. In this regard, see the pumps (304*a* to 304*d*) of the pump assembly (300) described below with reference to FIG. 10.

Gears of Pump.

In the embodiment shown in FIGS. 4, 6, and 7, the drive gear (200) defines an aperture (204) for receiving a drive shaft (not shown) by friction fit, such that the drive gear (200) and the drive shaft rotate in unison. Similarly, the idler gear (202) defines an aperture (206) for receiving an idler shaft (not shown) by friction fit, such that the idler gear (202) and the idler shaft rotate in unison. An annular bushing (not shown) may be provided between the gear (200, 202) and its associated shaft.

Figure 8A:
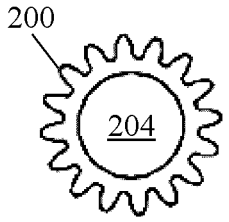
FIGS. 8A and 8B shows a transverse view, and an axial view, respectively, of a first embodiment of a drive gear for use in a rotary gear pump of the present invention.
Figure 9A:
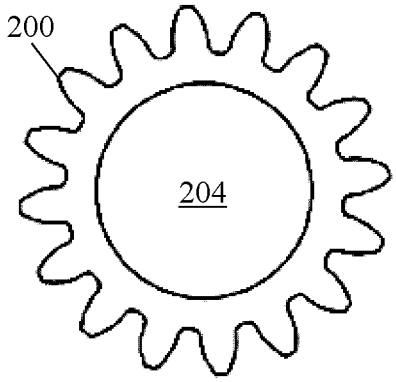
FIGS. 9A and 9B shows a transverse view, and an axial view, respectively, of a second embodiment of a drive gear having a larger diameter but shorter axial length than the drive gear of FIGS. 8A and 8B.
Figure 8B:
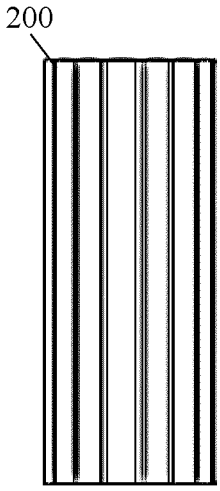
Figure 9B:
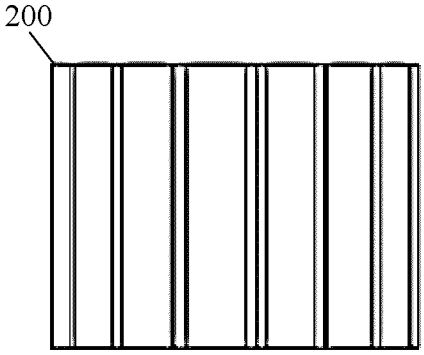

The pump capacity is positively related to the diameter of the gears (200, 202). In a conventional rotary gear pump (see FIG. 1), the theoretical maximum gear diameter is about half of the major diameter of the elongate housing. In contrast, referring to FIG. 6, the theoretical maximum gear diameter is only about one-third of the diameter of the housing (102). However, without having to increase the diameter of the housing (102), the effect of reduced gear diameter on pump capacity can be compensated by increased axial length of the gears. That is, a pump (100) of the present invention using a drive gear (200) shown in FIGS. 8A and 8B may have the same capacity as a conventional rotary gear pump using a drive gear (200) having a larger diameter but shorter axial length, as shown in FIGS. 9A and 9B.

Use and Operation of Pump.

In use and operation of embodiments of the pump, a drive shaft (not shown) is fixedly inserted into aperture (202) of the drive gear (200) and rotatably inserted into the bore (124). Similarly, an idler shaft (not shown) is fixedly inserted into aperture (204) of the drive gear (202) and rotatably inserted into the bore (126). A prime mover (not shown) is coupled (either directly or indirectly) to the drive shaft to drive clockwise rotation of the drive gear (200) (from the perspective of FIG. 6), which in turn drives counter-clockwise rotation of the idler gear (202) (from the perspective of FIG. 6). In FIGS. 6 and 7, the curved arrow lines show the resulting fluid flow through the pump (100). As the drive gear (200) and the idler gear (202) rotate, they displace fluid along the closely fitting partial cylindrical walls (118) defining the gear chamber (108). The operation of gear pumps is well known to those skilled in the art, and need not be further described.

Alternatively, the pump (100) may be used as a motor by supplying fluid under pressure to either the intake port (104) or the discharge port (106), and creating a fluid pressure differential therebetween, to drive rotation of the gears (200, 202).

Pump Assembly.

Figure 10:
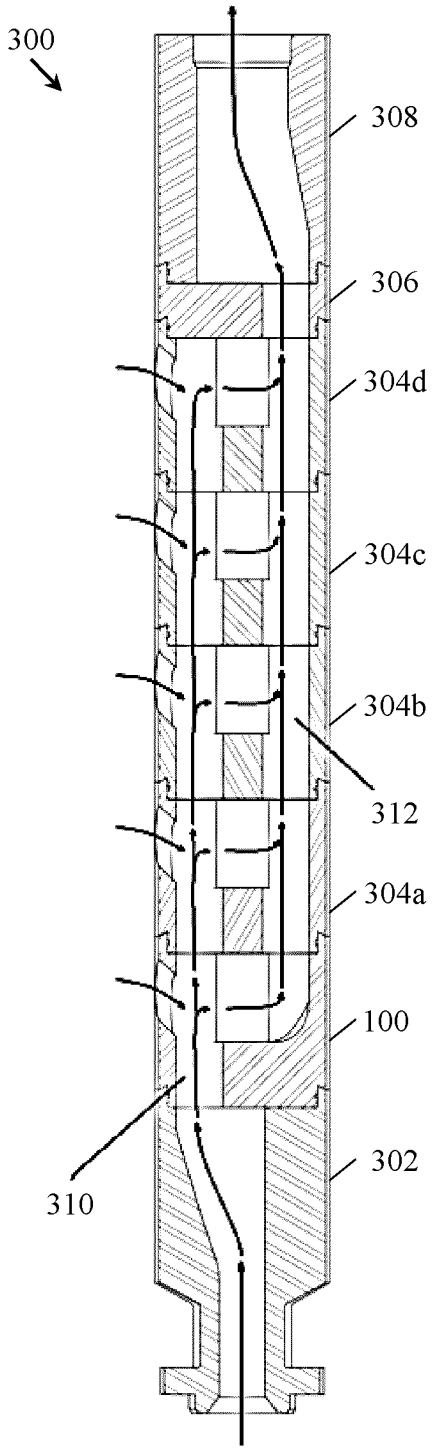
FIG. 10 shows an axial, midline sectional view of an embodiment of a pump assembly of the present invention, including the pump of FIG. 4.

FIG. 10 shows an embodiment of a pump assembly (300) of the present invention. The pump assembly (300) includes an intake tubular (302), a pump (100) such as that illustrated in FIG. 4, and additional pump modules or stages (304*a* to 304*d*), and may also include a transition tubular (306), and a discharge tubular (308). Each component is mated in a fluid tight manner to its immediately adjacent component by threaded pin and box connections, with sealing elements as needed. The discharge tubular (308) has a box end for mating in a fluid tight manner to another tubular (not shown). Pumps (304*a* to 304*d*) are similar to pump (100) of FIG. 4 in all material aspects, and as such, it will be understood that they have elements analogous to elements of pump (100). However, pumps (304*a* to 304*d*) differ from pump (100) in that their discharge chambers (116) extend axially through their bodies (112) to permit fluid communication axially through their housings (102). When the components of the pump assembly (300) are so assembled, the intake tubular (302) and the aligned intake chambers (114) of the pumps (100, 304*a* to 304*d*) collectively define an intake flow path (310), while the aligned discharge chambers (116) of the pumps (100, 304*a* to 304*d*), along with the transition tubular (306), and the discharge tubular (308) collectively define a discharge flow path (312).

In use and operation of the pump assembly (300), a single prime mover may be used to drive rotation of all the drive gears (200) of the pump assembly (300), by aligning their axes of rotation coaxially with each other, and by directly coupling the drive gears (200) of the pump assembly. "Directly coupled" or "direct coupling" as used herein to describe the relationship between a drive gear of a first pump and a drive gear of an axially adjacent second pump, refers to either a shaft of the drive gear of the first pump being connected to a shaft of the drive gear of the second pump so that the gears rotate in unison with each other, or the drive gears having a common shaft so that the gears rotate in unison with each other. For example, the prime mover may be coupled to a drive shaft coupled to the drive gear (200) of the terminal pump at either end of the assembly. The drive shafts of immediately adjacent pumps (100, 304*a* to 304*d*) may be directly coupled to each other using splined shafts and sleeves. Alternatively, a single drive shaft coupled to the prime mover may extend through each of the pump modules or stages (100, 304*a* to 304*d*) so as to be directly coupled to all the drive gears (200).

In FIG. 10, the curved arrow lines show the resulting fluid flow through the pump assembly (300) when the gears are rotated by the prime mover. The pumps (100, 304*a* to 304*d*) draw in fluid through their intake ports (104) "in parallel"—i.e., the intake ports (104) form multiple paths for fluid flow. The fluid flows entering the housings (102) from the intake ports (104) are combined with each other and fluid drawn in from the intake tubular (302) in the common intake flow path (310). The pumps (100, 304*a* to 304*d*) discharge fluid "in parallel" into the common discharge flow path (312).

In alternative embodiments, the number of pumps (100 and 300*a* to 304*d*) may be varied to add or subtract pump modules or stages, which would have the effect of varying the flow capacity of the pump assembly (300). In particular, by substituting or supplementing them with pump stages having alternative embodiments of transversely-oriented and/or axially-oriented intake ports(s) and/or discharge port (s) as described above, the pump assembly (300) may be varied to effect different intake and discharge fluid flow paths. For example, none, some, or all of a plurality of pump stages may draw in fluid into a common intake flow path (310); none, some, or all of the plurality of pump stages may discharge fluid into a common discharge flow path (312). For example, different fluid supply lines may be connected to different intake ports of different pump stages to convey fluid to the different pump stages without the need to flow through a common is intake flow path (310). For example, different fluid discharge lines may be connected to different discharge ports of different pump stages to convey discharged fluid to different destinations without the need to flow through a common discharge flow path (312).

Non-limiting exemplary uses of a pump assembly (300) as described herein, are described below with reference to embodiments of pump systems shown in FIGS. 11 to 13.

Downhole Pump System Driven by a Submersible Electric Motor.

Figure 11:
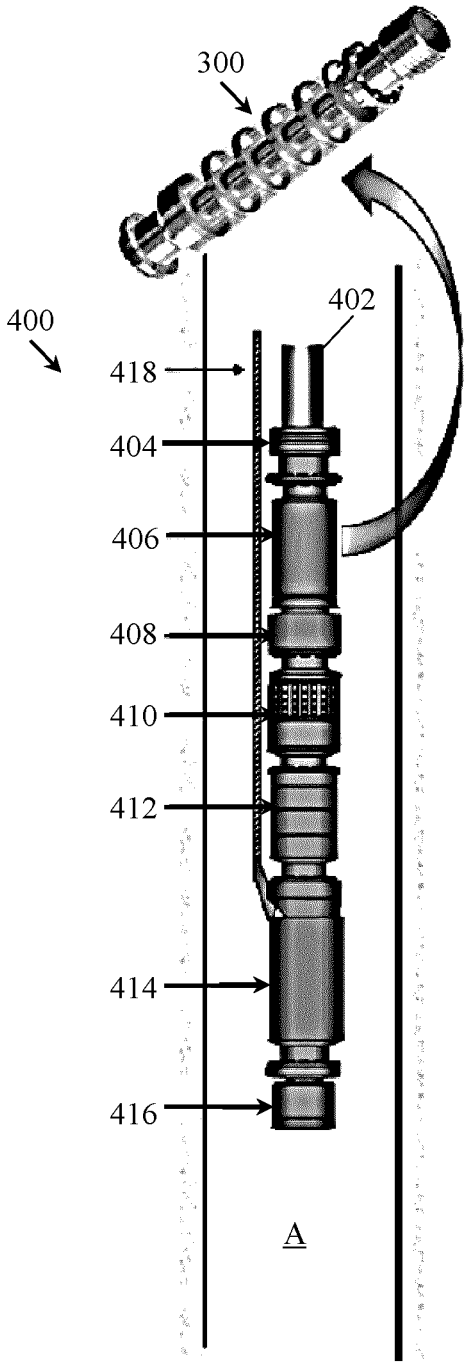
FIG. 11 shows an embodiment of a downhole pump system of the present invention, including the pump assembly of FIG. 10, driven by a submersible electric motor.

FIG. 11 shows an embodiment of a downhole pump system (400) at the bottom end of a production tubing string (402) in a wellbore. The system (400) may be used to pump produced reservoir fluids in the casing annulus (A) into and up the production tubing string (402) to the surface. The downhole pump system may include, from the uphole end to the downhole end, the following components: a discharge sub (404) for connection to the production tubing string (402); a pump housing sub (406) that encloses a pump assembly (300) as described herein; a gas handling sub (408) for venting gas to the casing annulus (A); a perforated intake sub (410) which exposes the intake ports (104) of the pump assembly (300) to the casing annulus (A); a sealing sub (412) for isolating downhole electronic components from fluid in the intake sub (410); a submersible electric motor (414); and optionally, a sensor (416) for monitoring downhole conditions in the casing annulus (A) (e.g., temperature or pressure) and/or conditions associated with the electric motor (414). A motor lead extension (MLE) (418) supplies electrical power from a power source at the surface to the electric motor (414) and may also include sensor data transmission lines. The electric motor (414) may be any suitable electric motor configured for downhole use (e.g., an induction motor or a permanent magnet motor) serves as the prime mover and is coupled, directly or indirectly (e.g., via a gear box) to the drive gears (200) of the pump assembly (300). Rotation of the drive gears of the pump assembly (300) pumps fluid from the casing annulus (A) up the production tubing string (402) to the surface. The central axis of the electric motor (414) and the axis of rotation of the electric motor (414) drive shaft may be coaxial with the central axes of the housings (102) of the pump assembly (300).

Downhole Pump System Driven by a Rotating Rod String.

Figure 12:
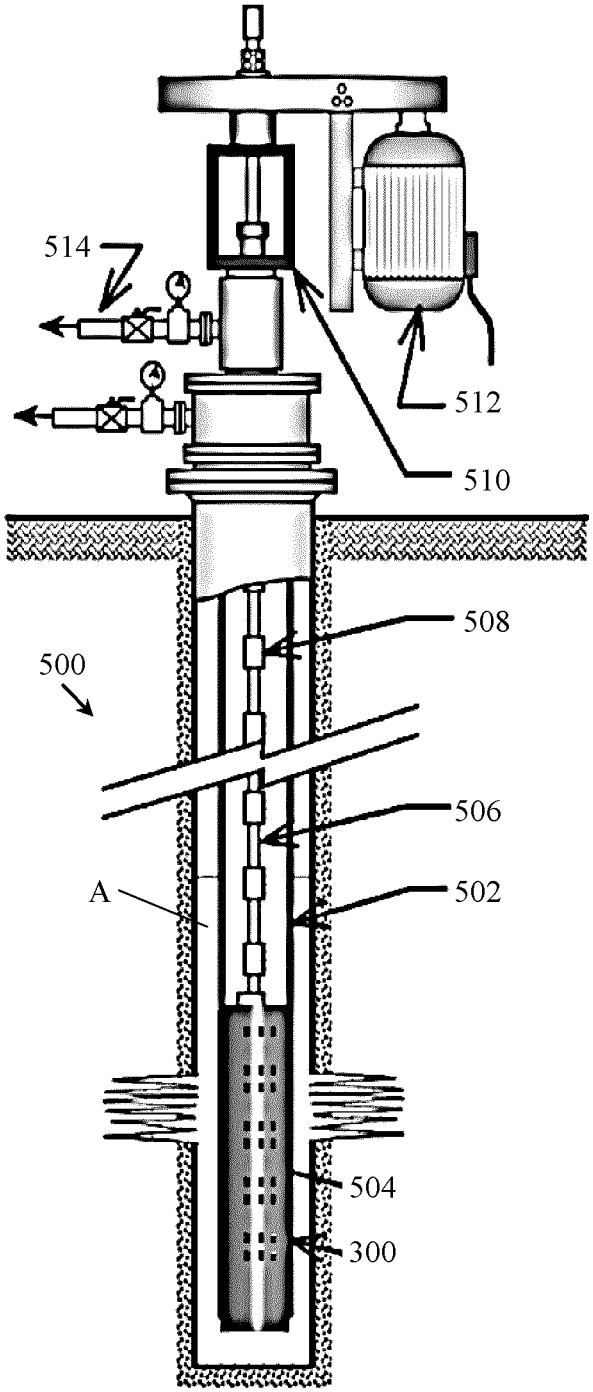
FIG. 12 shows another embodiment of a downhole pump system of the present invention, including the pump assembly of FIG. 10, driven by a rotating rod string coupled to a prime mover at the surface.

FIG. 12 shows an embodiment of a downhole pump system (500) at the bottom end of a production tubing string (502) in a wellbore. The system (500) may be used for pumping reservoir fluids from the casing annulus (A) up the production tubing string (502) to the surface. A pump assembly (300) as described herein is disposed within a perforated tubular intake (504) that is attached to the bottom end of the production tubing string (502). The tubular intake (504) permits fluid flow from the casing annulus (A) to the intake ports (104) of the pump assembly (300). The drive gears (200) of the pump assembly (300) are driven by a rod string (506) that is rotatably disposed within the production tubing string (502). The rod string (506) is fitted with centralizers (508) to transversely center the rod string (506) within the production tubing string (502). The rod string (506) is driven by a surface drive unit (510) and a prime mover (512) (e.g., an electric motor). The prime mover (512) drives rotation of the rod string (506), and hence the drive gears (200) of the pump assembly (300). Rotation of the gears of the pump assembly (300) pumps fluid from the casing annulus (A) up the production tubing string (502) to a flow line (514) attached to the well head. The axis of rotation of the rod string (506) may be coaxial with the central axes of the housings (102) of the pump assembly (300).

Skid-Mounted Pump System.

Figure 13:
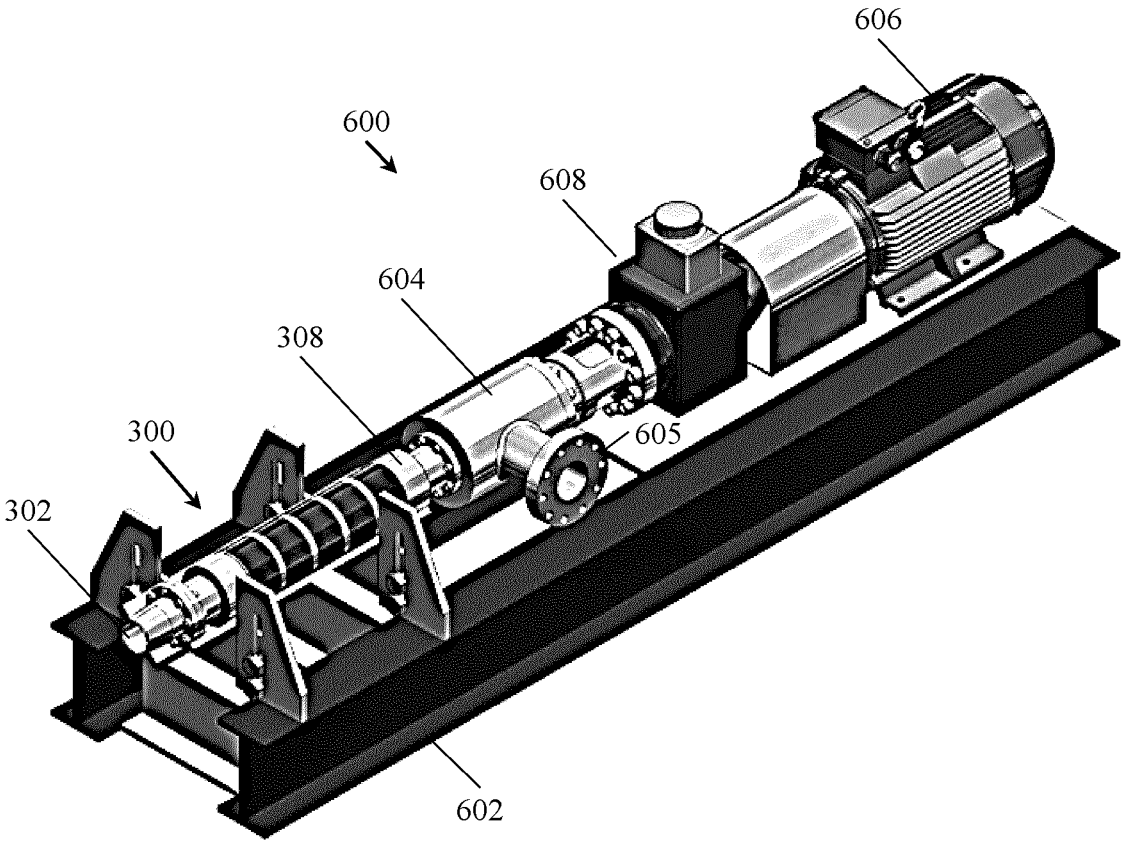
FIG. 13 shows an embodiment of a skid-mounted pump system of the present invention, including the pump assembly of FIG. 10.

FIG. 13 shows an embodiment of a surface pump system (600) mounted on a skid (602). The system (600) may be used in a variety of applications; non-limiting examples include pumping well treatment fluids (e.g., hydraulic fracturing fluid) from the surface into a wellbore, or pumping water to a discharge line to a storage tank. The pump system (600) includes a pump assembly (300) as described herein. The intake tubular (302) of the pump assembly (300) is, in use, connected to a fluid supply line attached to a storage tank containing the treatment fluid (not shown). The pump assembly (300) of FIG. 10 may be adapted for use in this pump system (600) by omitting or sealing the intake ports (104) of the pumps (100, 304*a* to 304*d*). The discharge tubular (308) of the pump assembly (300) is connected to a T-shaped tubular diverter (604), having a flange (605) for connection to a discharge line (not shown). A prime mover (606) (e.g., an electric motor, a hydraulic motor, or an internal combustion engine) is coupled to the drive gears (200) of the pump assembly (300) via a drive shaft (concealed from view), which passes through the tubular diverter (604) and a seal assembly (608), which isolates the prime mover (606) from fluid in the tubular diverter (604). Rotation of the gears of the pump assembly (300) pumps fluid from the storage tank containing the treatment fluid to the discharge line connected to the flange (605) of the tubular diverter (604). The central axis of the prime mover (606) and the axis of rotation of its associated drive shaft may be coaxial with the central axes of the housings (102) of the pump assembly (300).

Pump Assembly with Centered and Offset Drive Gears.

Referring to FIG. 5, the gear chamber (108) is transversely offset from the transverse center of pump housing (102). This limits the portion of the transverse cross-sectional area of pump housing (102) that can be occupied by gear chamber (102), which in turn limits the flow capacity of the pump (100) per unit axial length of the pump (100).

Figure 14:
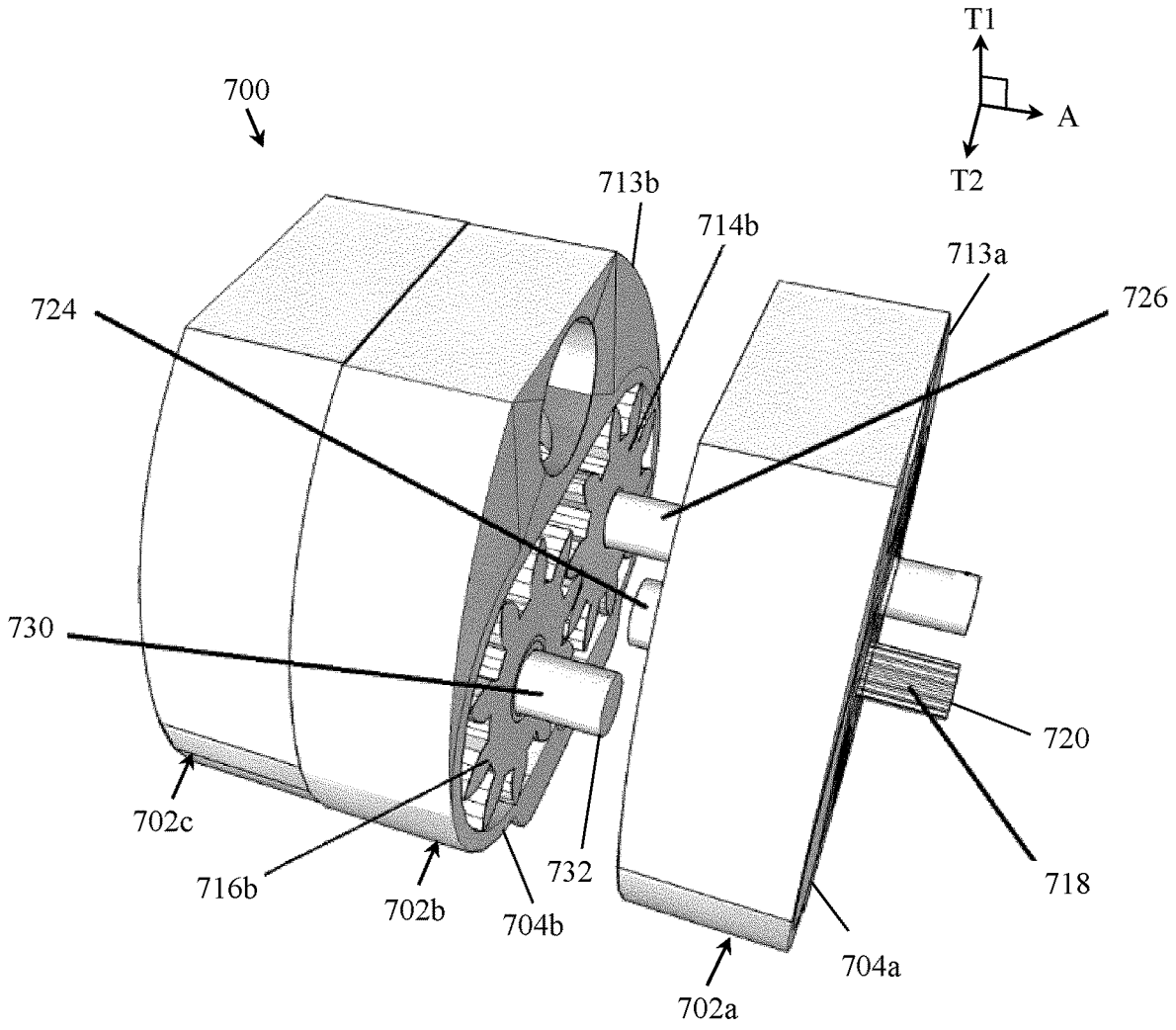
FIG. 14 shows an exploded perspective view of an embodiment of a pump assembly having centered and offset drive gears, in accordance with the present invention.
Figure 15:
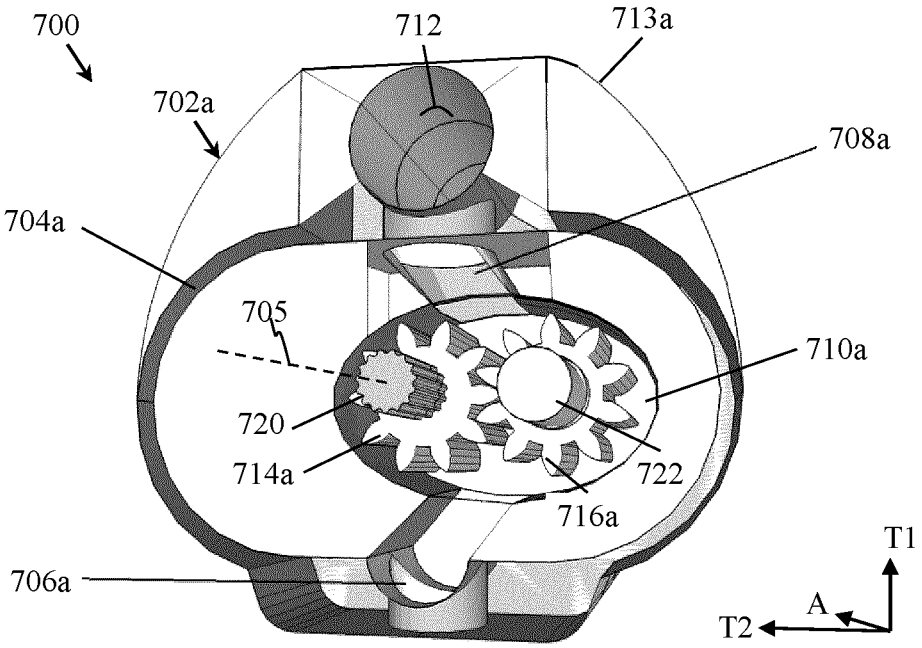
FIG. 15 shows a partial cut-away perspective view of the pump assembly of FIG. 14, as viewed from end of the first stage pump of the pump assembly.
Figure 16:
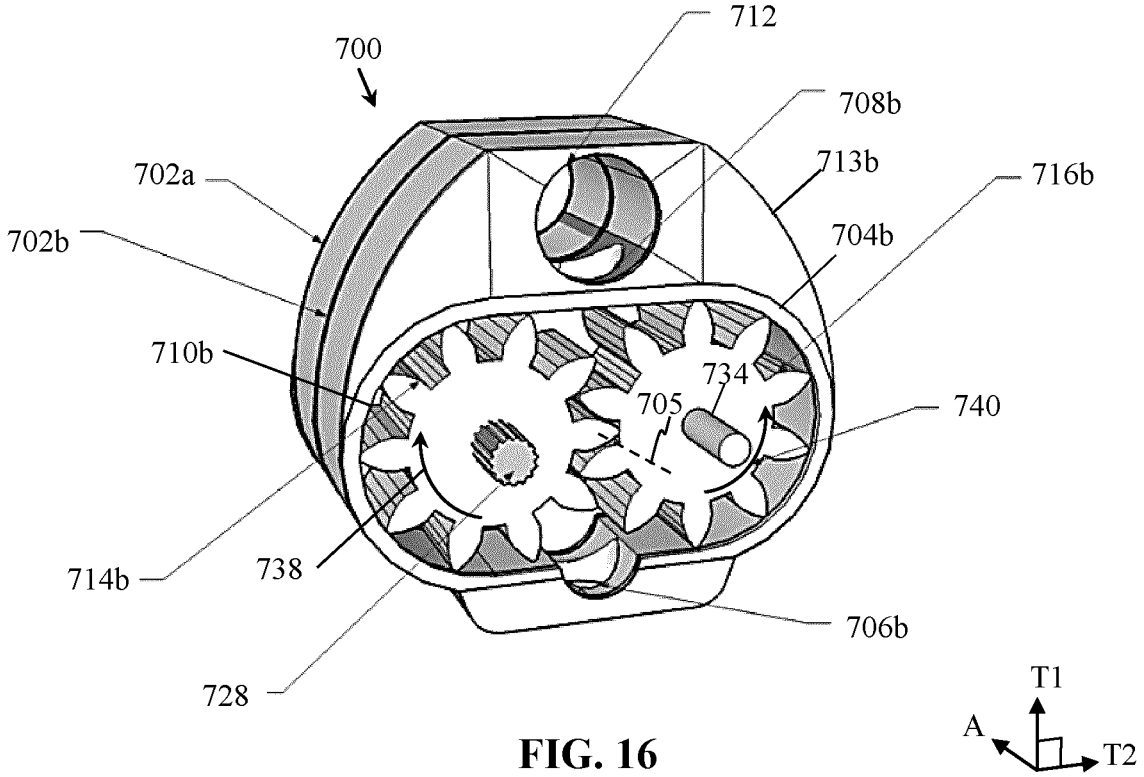
FIG. 16 shows a perspective view of part of the pump assembly of FIG. 14, as viewed from the end of the second stage pump of the pump assembly.

FIGS. 14 to 16 show views of an embodiment of a multi-stage rotary gear pump assembly (700) of the present invention that increases the flow capacity of a pump. In these Figures, mutually orthogonal directions are indicated by axes showing axial direction (A), first transverse direction (T1), and second transverse direction (T2). The axes of rotation of the gears of the pump assembly (700) are aligned with the axial direction (A).

FIG. 14 shows the pump assembly (700) having a first stage pump (702*a*), a second stage pump (702*b*), and a third stage pump (702*c*), with the first stage pump (702*a*) disassembled from the second stage pump (702*b*). FIG. 15 shows a partial cut-away view of the pump assembly (700) to reveal the internal configuration of the first stage pump (702*a*). FIG. 16 shows the pump assembly (700) with the third stage pump (702*c*) omitted to show the internal configuration of the second stage pump (702*b*).

In this embodiment, the first stage pump (720*a*) is a terminal pump of the pump assembly (700). In this embodiment, the third stage pump (702*c*) is the same as the second stage pump (702*b*). In other embodiments (not shown), the pump assembly (700) may have only two stages (702*a*; 702*b*), or have additional stage(s) of pump(s) extending from third stage pump (702*c*).

Each of the first and second stage pumps (702*b*; 702*b*) includes a pump housing (704*a*; 704*b*) defining an intake port (706*a*; 706*b*), a discharge port (708*a*; 708*b*) and a gear chamber (710*a*; 710*b*) in fluid communication with the intake port (706*a*; 706*b*) and the discharge port (708*a*; 708*b*).

In the embodiment shown in FIGS. 14 to 16, each pump housing (704*a*; 704*b*) has a stadium or obround shape in the transverse cross-section. In this embodiment, the first stage pump housing (704*a*) and the second stage pump housing (704*b*) have the same external dimensions. The central axis (705) of the housings (704*a*, 704*b*) as shown by the dashed line in FIGS. 15 and 16, extends in the axial direction (A) through the geometric center of the housings (704*a*, 704*b*) in the transverse cross-section (i.e., in the plane defined by the transverse directions (T1, T2)). In other embodiments (not shown), the transverse cross-sectional shape of the pump housings (704*a*; 704*b*) may differ. For example, the transverse cross-sectional shape of the pump housings (704*a*; 704*b*) may be circular, in a similar manner to the pump housing (102) shown in FIG. 4. In embodiments, the pump housings (704*a*; 704*b*) may be formed by a cylindrical casing that have threaded end connection(s) and that circumscribe a body, in similar manner to the casing (110) and body (112) shown in FIGS. 4 and 7. In such embodiments, the central axis of the housings (704*a*, 704*b*) may coincide with the center of the circular transverse cross-section of the housings (704*a*, 70*b*).

In the embodiment shown in FIGS. 14 to 16, the intake ports (706*a*; 706*b*) and the discharge ports (708*a*; 708*b*) are disposed on opposite sides of the gear chamber (710*a*; 710*b*) in the first transverse direction (T1). In the embodiment shown, each of the discharge ports (708*a*; 708*b*) is in fluid communication with a common discharge manifold (712) formed by parts (713*a*; 713*b*) extending from the pump housings (704*a*; 704*b*) on the side of the discharge ports (708*a*; 708*b*). In other embodiments (not shown), one or more of the intake ports (704*a*; 704*b*) may also be in fluid communication with a common intake manifold.

In the embodiment shown in FIG. 15, the first stage pump gear chamber (710*a*) has an oval shape in the transverse cross-section, with a central axis that is offset from the central axis (705) of the first stage pump housing (104*a*). In other embodiments, the first stage pump gear chamber (710*a*) may have a different shape, and position within the first stage pump housing (704*a*).

In the embodiment shown in FIG. 16, the second stage gear chamber (710*b*) has a stadium or obround shape in the transverse cross-section, with a central axis that is substantially coaxial with the central axis (705) of the second stage pump housing (704*b*). In this embodiment, the transverse cross-sectional area of the second stage pump gear chamber (710*b*) is larger than the transverse cross-sectional area of the first stage pump gear chamber (710*a*). Therefore, the portion of the transverse cross-sectional area of the second stage pump housing (704*b*) occupied by the second stage pump gear chamber (710*b*), is larger than the portion of the transverse cross-sectional area of the first stage pump housing (704*a*) occupied by the first stage pump gear chamber (710*a*). In other embodiments, the second stage pump gear chamber (710*b*) may have a different shape, and position within the second stage pump housing (704*b*). In other embodiments, the transverse cross-sectional area of the second stage pump gear chamber (710*b*) may be smaller, or the same as the transverse cross-sectional area of the first stage pump gear chamber (710*a*).

Each of the stage of pumps (702*a*; 702*b*) includes a drive gear (714*a*; 714*b*) intermeshed with an idler gear (716*a*; 716*b*). The drive gear (714*a*; 714*b*) and the idler gear (716*a*; 716*b*) are rotatably disposed within the gear chamber (710*a*; 710*b*) for displacing fluid from the intake port (706*a*; 706*b*) to the discharge port (708*a*; 708*b*). In this regard, the principle of operation of a rotary gear pump is known in the art, and need not be further described.

In the embodiment shown in FIGS. 14 and 15, the first stage pump drive gear (714*a*) has a first stage pump drive shaft (718). The first stage pump drive shaft (718) has a splined first end (720) for rotational coupling with a drive shaft of a prime mover. The first stage pump drive shaft (718) has a second end (724) that is rotatably supported within an aperture formed by a transversely extending end plate of the first stage pump housing (704*a*).

In the embodiment shown in FIG. 15, the axis of rotation of the first stage pump drive gear (714*a*) is substantially coaxial with the central axis (705) of the first stage pump housing (704*a*). In other embodiments where the transverse cross-sectional shape of the first stage pump housing (704*a*) is a circle, the axis of rotation of the first stage pump drive gear (714*a*) may be coaxial with a central axis passing through the center of such circle. Accordingly, the drive shaft of the prime mover may also be substantially coaxial with the central axis of the first stage pump housing (704*a*).

The axis of rotation of first stage pump idler gear (716*a*) and the axis of rotation of the second stage pump drive gear (714*b*) are coaxial with each other. In FIG. 14, for example, the axis of rotation of each drive gear (714*a*; 714*b*) and each idler gear (716*a*; 716*b*) is parallel to the axial direction (A). Hence, the axes of rotation of first stage pump idler gear (716*a*) and the second stage pump drive gear (714*b*) coincide with each other in both the first transverse direction (T1) and the second transverse direction (T2).

The first stage pump idler gear (716*a*) and the second stage pump drive gear (714*b*) are directly coupled for rotation in unison with each other. "Directly coupled" or "direct coupling" as used herein to describe the relationship between an idler gear of the first pump and a drive gear of an axially adjacent second pump, refers to either a shaft of the idler gear of the first pump being connected to a shaft of the drive gear of the second pump so that the gears rotate in unison with each other, or the gears having a common shaft so that the gears rotate in unison with each other. In the embodiment shown in FIG. 14, for example, the first stage pump idler gear (716*a*) and the second stage pump drive gear (714*b*) are directly coupled by a shaft (726) extending axially between them. As shown in FIG. 16, the shaft (726) has a splined end (728) for rotational coupling with a shaft associated with the drive gear of the third stage pump (702*c*). In other embodiments, a shaft of the first stage pump idler gear (716*a*) may be connected to a shaft of the second stage pump drive gear (714*b*), using a connector such as a splined connection.

In the embodiment shown in FIGS. 14 and 16, the second stage pump idler gear (714*b*) has a second stage pump idler shaft (730). The second stage pump idler shaft (730) has a first end (732) (FIG. 14) that is rotatably supported within an aperture formed by a transversely extending end plate of the first stage pump housing (704*a*). The second stage pump idler shaft (730) has a second end (734) (FIG. 16) that is rotatably supported within an aperture formed by a transversely extending end plate of the second pump housing (702*b*).

Figure 17:
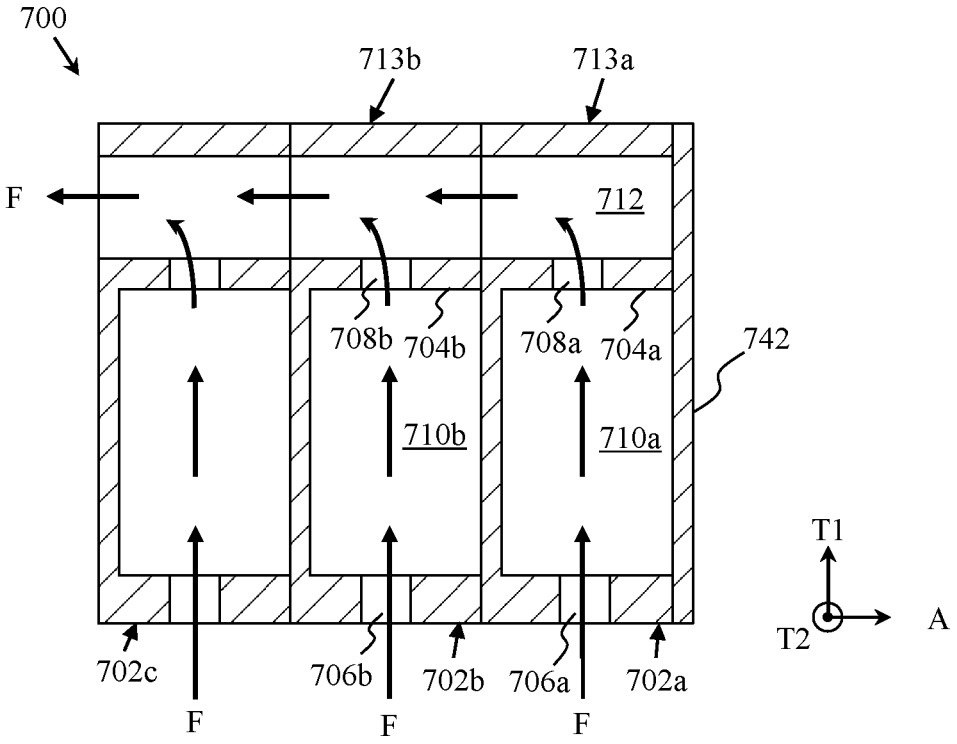
FIG. 17 shows an axial, midline sectional view of the pump assembly of FIG. 14, with the gears omitted, to show the flow path of a fluid through the pump assembly.

FIG. 17 shows an axial, midline sectional view of the pump assembly (700), with an end plate (42) attached to the first stage pump housing (704*a*) to seal the first stage pump gear chamber (710*a*). The gears (714*a*; 714*b*; 716*a*; 716*b*) are omitted to show the flow path of fluid (F) by arrow lines. When a drive shaft of a prime mover is connected to the splined end (720) of the first stage pump drive shaft (718), application of torque thereto results in rotation of first stage pump drive gear (714*a*), and counter-rotation of intermeshed first stage pump idler gear (716*a*). This pressurizes fluid from the first stage pump intake port (706*a*) to the first stage pump discharge port (708*a*), and into discharge manifold (712). Counter-rotation of first stage pump idler gear (716*a*) is transmitted by shaft (726) to the second stage pump drive gear (714*b*). Counter-rotation of second stage pump drive gear (714*b*) (as shown by the clockwise curved arrow line (738) in FIG. 16) drives rotation of intermeshed second stage pump idler gear (716*b*) (as shown by the counter-clockwise curved arrow line (740) in FIG. 16). This pressurizes fluid from the second stage pump intake port (706*b*) to the second stage pump discharge port (708*b*), and into discharge manifold (712). Counter-rotation of second stage pump drive gear (714*b*) is transmitted via splined end (728) of shaft (726) to the drive gear of the third stage pump (702*c*).

The pump assembly (700) allows the drive shaft of a prime mover to be coaxial with a central axis of the pump housings (704*a*; 704*b*), without the need for an offset drive coupling. Further, the first stage pump (702*a*) both contributes to the overall flow capacity of the pump assembly (700), and transmits torque from the prime mover to the second stage pump drive gear (706*b*). The flow capacity of the second stage pump (702*b*) (and any further stages) of the pump assembly (700) is not compromised by the drive shaft of the prime mover being coaxial with a central axis of the pump housings (704*a*; 704*b*).

The pump assembly (700) as described herein may be disposed between an intake tubular and a discharge tubular, in a manner similar to how pumps (100; 304*a* to 304*d*) are disposed between the intake tubular (302) and the discharge tubular (308) in the pump assembly shown in FIG. 10.

A pump assembly (700) having a first stage pump (702*a*), and a second stage pump (702*b*) as described herein may be uses in a variety of pump systems.

For example, the pump assembly (700) as described herein, rather than the pump assembly (300) as described herein, may be disposed in the pump housing sub (406) of the pump system shown in FIG. 11. A drive shaft of the electric motor (414) may be coupled to the splined end (720) of the first stage pump drive shaft (718). The central axis of the electric motor (414) and the axis of rotation of the drive shaft may be coaxial with a central axis of the housings (704*a*; 704*b*) of the pump assembly (700).

For example, the pump assembly (700) as described herein, rather than the pump assembly (300) as described herein, may be contained within the perforated tubular intake (504) of the pump system shown in FIG. 12. The rod string (506) may be coupled to the splined first end (720) of the first stage pump drive shaft (718). The axis of rotation of the rod string (506) may be coaxial with a central axis of the housings (704*a*; 704*b*) of the pump assembly (700).

For example, the pump assembly (700) as described herein, rather than a pump assembly (300), may be included in the surface pump system (600) shown in FIG. 13. The prime mover (606) and a drive shaft of the prime mover (606) may be coupled to the splined first end (720) of the first stage pump drive shaft (718). The central axis of the prime mover (606) and the axis of rotation of its drive shaft may be coaxial with a central axis of the housings (704*a*; 704*b*) of the pump assembly (700).

Additional Embodiments.

In addition to the embodiments of the present invention described above, the scope of this disclosure includes additional embodiments of the present invention having combinations of features not specifically illustrated in the drawings or explicitly linked together in this description.

Interpretation.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A pump assembly comprising a first pump and a second pump, wherein each of the pumps comprises:

(a) a housing having a central axis extending in an axial direction and perpendicular to a transverse direction, and defining an intake port, a discharge port, and a gear chamber in fluid communication with the intake port and the discharge port; and (b) a drive gear intermeshed with an idler gear, wherein the drive gear and the idler gear are rotatably disposed within the gear chamber for displacing fluid from the intake port to the discharge port; and wherein the first pump and the second pump are aligned in the axial direction;

wherein the first pump drive gear has an axis of rotation that is coaxial with the central axis of the first pump housing;

wherein the housing defines an intake chamber permitting fluid communication from the at least one intake port to the gear chamber, and the intake chamber extends axially through the housing, adjacent and parallel to the gear chamber, to permit fluid communication axially through the housing; and wherein:

the first pump idler gear is directly coupled to the second pump drive gear, and an axis of rotation of the first pump idler gear and an axis of rotation of the second pump-drive gear are coaxial with each other.

2. The pump assembly of claim 1, wherein the at least one intake port of the first pump and the at least one intake port of the second pump are in fluid communication with each other, and/or wherein the at least one discharge port of the first pump and the at least one discharge port of the second pump are in fluid communication with each other.

3. The pump assembly of claim 2, wherein the discharge port of the pumps are in fluid communication with a tubing string within a wellbore.

4. The pump assembly of claim 1, configured to be driven by a prime mover with a driven shaft, wherein an axis of rotation of the drive shaft and/or a central axis of the prime mover is coaxial with the central axis of the housing of the first pump.

* * * * *